United States Patent [19]

Gangwisch et al.

[11] Patent Number: 4,457,854

[45] Date of Patent: Jul. 3, 1984

[54] HIGH BULK DENSITY CARBONATE-ZEOLITE BUILT HEAVY DUTY NONIONIC LAUNDRY DETERGENT

[75] Inventors: William J. Gangwisch, New Brunswick; Virgil J. Richter, West Orange; Harold E. Wixon, New Brunswick; Joseph B. Wraga, Bogota, all of N.J.

[73] Assignee: Colgate Palmolive Company, New York, N.Y.

[21] Appl. No.: 430,976

[22] Filed: Sep. 30, 1982

Related U.S. Application Data

[60] Division of Ser. No. 384,994, Jun. 4, 1982, Pat. No. 4,406,808, which is a continuation of Ser. No. 839,781, Oct. 6, 1977, abandoned.

[51] Int. Cl.[3] ..... C11D 3/08; C11D 3/10; C11D 3/12; C11D 11/02

[52] U.S. Cl. ..... 252/91; 252/140; 252/174.25

[58] Field of Search ..... 252/90, 91, 135, 140, 252/174, 174.21, 174.25, 179

[56] References Cited

U.S. PATENT DOCUMENTS

| | | | |
|---|---|---|---|
| 3,755,180 | 8/1973 | Austin | 252/99 |
| 3,819,526 | 6/1974 | Pierce | 252/135 |
| 3,886,098 | 5/1975 | DiSalvo | 252/540 |
| 3,920,586 | 11/1975 | Bonaparte | 252/531 |
| 3,932,316 | 1/1976 | Sagel | 252/532 |
| 3,985,669 | 10/1976 | Krummel | 252/116 |
| 4,000,094 | 12/1976 | Fleming | 252/557 |
| 4,019,999 | 4/1977 | Ohren | 252/140 |
| 4,077,897 | 3/1978 | Gault | 252/99 |
| 4,264,464 | 4/1981 | Gangwisch | 252/91 |

*Primary Examiner*—Dennis L. Albrecht

[57] ABSTRACT

A free flowing phosphate-free high bulk density particulate heavy duty nonionic laundry detergent is comprised of particles of spray dried base beads containing ion exchanging zeolite and sodium carbonate with which is mixed a particulate water soluble sodium silicate and into which is absorbed a nonionic detergent. The product is made by spray drying an aqueous mixture or slurry of the zeolite and carbonate, mixing with the beads produced a water soluble silicate powder such as hydrous sodium silicate of $Na_2O:SiO_2$ ratio of about 1:2 and mixing nonionic detergent in liquid form with the mixture of spray dried base beads and silicate powder and absorbing the nonionic detergent into said mixture.

7 Claims, No Drawings

HIGH BULK DENSITY CARBONATE-ZEOLITE BUILT HEAVY DUTY NONIONIC LAUNDRY DETERGENT

This is a division of application Ser. No. 384,994 filed June 4, 1982 now U.S. Pat. No. 4,406,808, which is a continuation of application Ser. No. 839,781; filed Oct. 6, 1977, now abandoned.

This invention relates to built synthetic organic detergent compositions useful for the heavy duty laundering of washable clothing and other textile items, and to a method for the manufacture thereof. More particularly, it relates to an improved non-phosphate synthetic organic detergent composition based on nonionic synthetic organic detergent, synthetic zeolite builder, sodium carbonate and hydrous sodium silicate, which is free flowing and of high bulk density and deposits little residue on washed materials.

Although synthetic organic detergent compositions have long been based on mixtures of synthetic organic detergent, usually anionic detergent, such as a linear alkyl benzene sulfonate, and builder salt, usually pentasodium tripolyphosphate, because of anti-eutrophication laws and governmental regulations the phosphate content of heavy duty detergent compositions has been limited and in some instances it has been considered desirable to produce low phosphate or phosphate-free detergent compositions. Water insoluble builders, such as bentonite and natural zeolites had previously been employed in soap and synthetic organic detergent compositions for their desirable effect in removing hardness ions, such as calcium and magnesium ions, from wash waters. More recently, with the availability of synthetic zeolites of improved hardness ion-counteracting properties, such zeolites have been included in detergent products to remove such ions and to improve detergency of the synthetic organic (usually anionic) detergent present. Such products may be of low phosphate content or free of phosphate and may be chemically inactive and non-nutritive, hence not contributing to algae growth and eutrophication of inland waters. Although the detergent compositions may be advantageous in those respects, it has been noted that materials washed with them can have objectionable quantities of residue deposited on them. This is most objectionable when the light-colored residue is readily apparent on a dark material. Accordingly, efforts have been made to reduce the depositing of such residue while still producing a satisfactory detergent. In U.S. Pat. No. 3,985,669 it is reported that less residue is present in such detergent compositions when the quantity of silicate is maintained low. However, with comparatively large quantities of synthetic zeolite, especially that of a type prone to deposit on such substrates, objectionable deposits can still result. Also, reducing the proportion of silicate present may diminish the anti-corrosive effect of such normally desirable component of synthetic detergent compositions. Accordingly, other ways of preventing such deposits have been the subjects of research projects.

Recently it has been considered desirable by the assignee of the present invention to produce free flowing and comparatively high bulk density particulate heavy duty laundry detergents so that relatively small quantities of these can be employed and will effectively clean in normal heavy duty laundering operations. It has been found that a combination of nonionic detergent, synthetic zeolite, sodium carbonate and sodium bicarbonate can be made into a free flowing, high bulk density, phosphate-free product. For example, in U.S. patent application Ser. No. 747,002, filed Dec. 2, 1976, in which one of the present co-inventors is the named inventor, a mixed salt, such as Wegscheider's salt, is tumbled with nonionic detergent and the product is coated with synthetic zeolite powder. While the products made are useful detergents of desired high bulk density, they may be of somewhat different appearance from that of conventional detergents normally purchased by the householder and therefore they might not be as readily accepted in the marketplace. Also, products which are spray dried or are made substantially from spray dried base beads, which are produced from homogeneous crutcher mixes, tend to be more uniform in composition and when materials blended with them constitute only minor proportions of the final product generally the post-spraying and mixing processes utilized in their manufacture do not require as strict control to ensure obtaining production of desirably homogeneous and free flowing products, compared to the method of Ser. No. 747,002, for example. Additionally, most detergent manufacturers are equipped with spray drying facilities and continuation of the use of such is often economically desirable. The present methods allow production of a free flowing, high bulk density, phosphate-free (or low phosphate) heavy duty laundry detergent of non-sifting characteristics, good washing properties, low residue deposition characteristics and attractive appearance to be readily carried out by methods utilizing for a substantial part equipment already on hand and with which operators are familiar.

In accordance with the present invention a method of manufacturing a free flowing, phosphate-free, particulate heavy duty laundry detergent of bulk density greater than 0.6 g./ml. comprises spray drying an aqueous mixture of ion exchanging zeolite, sodium carbonate and water to a moisture content in the range of about 2 to 16% so that the proportion of zeolite to sodium carbonate in the spray dried beads produced is in the range of 1:0.1–1.5 and mixing with said beads from 0.1 to 0.3 part of hydrous sodium silicate in particulate form and 0.2 to 1.0 part of nonionic detergent in liquid form per part of zeolite so that such detergent is absorbed into the beads. The invention is also in the product resulting and other such products which comprise beads of zeolite and sodium carbonate in the proportion of 1:0.1–1.5, having mixed with them from 0.1 to 0.3 part of hydrous sodium silicate in particulate form and 0.2 to 1.0 part of nonionic detergent per part of zeolite, which nonionic detergent is absorbed into the spray dried beads and may hold the hydrous silicate in or on the beads. Proportions given are on anhydrous bases.

Nonionic detergents are listed at length in McCutcheon's *Detergents and Emulsifiers,* 1973 Annual and in *Surface Active Agents,* Vol. II, by Schwartz, Perry and Berch (Interscience Publishers, 1958), the descriptions of both of which are hereby incorporated by reference. Such detergents may be liquid, pasty or waxy solids at room temperature (20° C.) and are usually either sufficiently water soluble to dissolve promptly in water or will quickly melt at the temperature of the wash water, as when that temperature is about 30° or 40° C. While the nonionic detergent employed will normally be one which is either liquid or pasty at room temperature, often preference will be given to normally liquid products because these readily penetrate into the interiors of the base particles, surprisingly leaving little or no material at the surfaces thereof, thus avoiding any tackiness due to presence of the nonionic detergent at the particle surfaces. The use of the normally liquid nonionic detergents allows room temperature application of the nonionic material to the base particles and avoids problems encountered due to any premature solidification of the nonionic or due to the presence of a pasty material near the surfaces thereof, which can be the result of undesired quick cooling of such nonionic detergent before it has satisfactorily penetrated into the interior of the base particle. Thus, although it would have been expected that one would prefer to employ a solid ionic detergent or at least one which is normally pasty or semi-solid because it would be considered that such would be less liable to make a tacky product of poor flow properties and susceptibility toward lumping or setting on storage than liquid nonionic detergents, this is not the case. If the base beads are kept warm enough and the nonionic detergent is applied in liquid state, as may be effected when normally solid or pasty nonionic detergent is heated sufficiently, the product resulting, providing that penetration into the base bead interior is sufficient, will be as good as the preferred liquid nonionic detergent-base bead compositions with respect to the flow and non-lumping properties but even in such case the liquid nonionic detergent is more amenable to being dispersed readily in aqueous media and therefore is more quickly effective in wash water. Generally, if a normally pasty, semi-solid or solid nonionic detergent is employed, when it is applied to the base beads it will be in the liquid state and usually will be at a temperature below 50° or 60° C., always below 70° C. and preferably below 45° C. For example, when a normally solid nonionic detergent such as Alfonic 1618–65 is employed, it will be heated so as to be a liquid upon application but when Neodol 25-6.5 or 25-7 is used heating will be unnecessary, providing that room temperature application, such as at 25° C., is effected.

Typical useful nonionic detergents are the poly-(lower alkenoxy) derivatives that are usually prepared by the condensation of lower (2 to 4 carbon atoms) alkylene oxide, e.g., ethylene oxide, propylene oxide (with enough ethylene oxide to make a water soluble product), with a compound having a hydrophobic hydrocarbon chain and containing one or more active hydrogen atoms, such as higher alkyl phenols, higher fatty acids, higher fatty mercaptans, higher fatty amines and higher fatty polyols and alcohols, e.g., fatty alcohols having 8 to 20 or 10 or 12 to 18 carbon atoms in an alkyl chain and alkoxylated with an average of about 3 to 30, preferably 5 to 20 and more preferably 5 to 12 lower alkylene oxide, e.g., ethylene oxide, units. Preferred nonionic detergents are those represented by the formula $$RO(C_2H_4O)_nH$$

wherein R is the residue of a linear saturated primary or secondary alcohol (an alkyl) of 10 to 18 carbon atoms and n is an integer from 5 to 20 or 5 to 12. The preferred nonionic detergents may be referred to as higher fatty alcohol polyoxyethylene ethanols (the terminal ethanolic part of these ethers is included in the number of oxyethylene groups counted in the mol of the nonionic). Typical commercial nonionic surface active agents suitable for use in the invention include Neodol ®23-6.5, an ethoxylation product with an average of about 6.5 mols of ethylene oxide per mol of a 12 to 13 carbon atom chain fatty alcohol, Neodol 25-7, a 12 to 15 carbon atom chain fatty alcohol ethoxylated with an average of 7 of the ethylene oxide units, Neodol 45-11, which is an ethoxylation product (having an average of about 11 ethylene oxide units) of a 14 to 15 carbon atom (average) chain fatty alcohol (all made by Shell Chemical Company) and Alfonic ®1618-65, which is a 16 to 18 carbon alkanol ethoxylated with an average of 10 to 11 ethylene oxide units (Continental Oil Company). Also useful are the Igepals ® of GAF Co., Inc. In the above description higher, as applied to higher alkyl, higher fatty, etc., means that 8 to 20, preferably from 10 or 12 to 18 carbon atoms are present.

The zeolites utilized in the present invention include the crystalline, amorphous and mixed crystalline-amorphous zeolites of natural or synthetic origin or mixtures thereof that will be of satisfactorily quick and sufficiently effective hardness ion counteracting activity. Preferably, such materials are able to react sufficiently rapidly with a hardness cation, such as one of calcium, magnesium, iron and the like, to soften the wash water before adverse reactions of such hardness ions with fibers of the laundry, any soils thereon and any constituents of the synthetic organic detergent compositions made according to the present invention, or any combination thereof. The useful range of calcium ion exchange capacities is from about 200 milligram equivalents of calcium carbonate hardness per gram of aluminosilicate to 400 or more of such milligram equivalents (on an anhydrous zeolite basis), per gram. Preferably such range is about 250 to 350 milligram equivalents per gram.

The water insoluble crystalline aluminosilicates used are often characterized by having a network of substantially uniformly sized pores in the range of about 3 to 10 Angstroms, often being about 4 Å (nominal), such size being uniquely determined by the unit structure of the particular type of zeolite crystal. Of course, zeolites containing two or more such networks of different pore sizes can also be satisfactorily employed, as can be mixtures of such crystalline materials with each other and with amorphous materials.

The zeolite should be a univalent cation-exchanging zeolite, i.e., it should be an aluminosilicate of a univalent cation, such as sodium, potassium, lithium (when practicable) or other alkali metal or, ammonium. Preferably the univalent cation of the zeolite molecular sieve is an alkali metal cation, especially sodium or potassium, and most preferably is sodium, but various other cations are also useful.

Crystalline types of zeolites utilizable as molecular sieves in the invention, at least in part, include zeolites of the following crystal structure groups: A, X, Y, L, mordenite, and erionite, of which types A and X are preferred. Mixtures of such molecular sieve zeolites can also be useful, especially when type A zeolite is present. These crystalline types of zeolites are well known in the art and are more particularly described in the text *Zeolite Molecular Sieves,* by Donald W. Breck, published in 1974 by John Wiley & Sons. Typical commercially available zeolites of the aforementioned structural types are listed in Table 9.6 at pages 747–749 of the Breck text, which table is incorporated herein by reference.

Preferably the zeolite used in the invention is synthetic and it is most preferable that it be of type A or similar structure, particularly described at page 133 of the aforementioned text. Good results have been obtained when a Type 4 A molecular sieve zeolite is employed, wherein the univalent cation of the zeolite is sodium and the pore size of the zeolite is about 4 Angstroms. Such zeolite molecular sieves are described in U.S. Pat. No. 2,882,243, which refers to them as Zeolite A.

Molecular sieve zeolites can be prepared in either a dehydrated or calcined form which contains from about 0 or about 1.5% to about 3% of moisture or in a hydrated or water loaded form which contains additional bound water in an amount from about 4 up to about 36% of the zeolite total weight, depending on the type of zeolite used. The water-containing or hydrate form of the molecular sieve zeolite is preferred in the practice of this invention. The manufacture of such hydrated crystals is well known in the art. For example, in the preparation of Zeolite A, referred to above, the hydrated zeolite crystals that are formed in the crystallization medium (such as a hydrous amorphous sodium aluminosilicate gel) are used without the high temperature dehydration (calcining to 3% or less water content) that is normally practiced in preparing such crystals for use as catalysts, e.g., cracking catalysts. The crystalline zeolite, in either completely hydrated or partially hydrated form, can be recovered by filtering off the crystals from the crystallization medium and drying them in air at ambient or other suitable temperature so that their water contents are as desired, usually being in the range of about 5 to 20% moisture, preferably 15 to 22%. However, because at least partial hydration may sometimes be effected during manufacture of the compositions of the present invention, the moisture content of the molecular sieve zeolite being employed may sometimes be as low as 0 percent at the start of the process of manufacturing the present detergent compositions.

Preferably the zeolite to be used will be initially in a finely divided state, with the ultimate particle diameters being below 15 microns, e.g., 0.001 to 15 microns, preferably being from 0.01 to 10 microns and especially preferably of 0.01 to 8 microns in mean particle size, e.g., 4 to 8 microns, if crystalline and 0.01 to 0.1 micron, e.g., 0.01 to 0.05 micron, if amorphous.

Although the crystalline synthetic zeolites are more common and better known, amorphous zeolites may be employed instead and are often superior to the crystalline materials in various important properties, as will be described, as may be mixed crystalline-amorphous materials and mixtures of the various types of zeolites described. The particle sizes are pore sizes of such materials will usually be like those previously described but variations from the described ranges may be made, providing that the materials function satisfactorily as builders in the present compositions and do not objectionably overwhiten dyed materials with which they are treated in aqueous media. Various suitable crystalline molecular sieve zeolites are described in four U.S. patent applications of Bao-Ding Cheng, Serial Nos. 467,688, filed May 7, 1974; 503,734, filed Sept. 6, 1974; and 640,793 and 640,794, filed Dec. 15, 1975, all of which are hereby incorporated by reference for such descriptions and for descriptions therein of other materials within this invention. Other useful such molecular sieve zeolites are illustrated in German Offenlegungsschriften Nos. 2,412,837 and 2,412,839 both of which are incorporated herein by reference. U.S. Pat. No. 3,985,669 and U.S. patent application Ser. No. 747,002, previously mentioned, are incorporated by reference, too, for their descriptions of zeolites and other components of the present compositions and other relevant disclosures. A preferred ion exchange zeolite is the amorphous zeolite of Belgian Pat. No. 835,351 of the formula $$M_2O.Al_2O_3.(SiO_2)_z.wH_2O$$

wherein M is a monovalent cation, preferably an alkali metal, z is from 1.5 or 2.0 to 3.8 or 4 (2 is sometimes preferable) and w is from 2.5 to 6, especially when M is sodium. Such patent and applications are also incorporated herein by reference to avoid the necessity for lengthy recitations of such materials, methods for their manufacture and uses, etc.

The formula given above may be varied to $$(Na_2O)_x.(Al_2O_3)_y.(SiO_2)_z.wH_2O$$

and usually, when x is 1, y will be from 0.8 to 1.2, z will be from 1.5 to 5 and w will be 0 to 9, such limits preferably being 0.9 to 1.1, 2.0 and 3.8 and 2.5 to 6 or 3.0 to 4.5 thereabout. The chemical or structural formula will preferably be the following or approximately of that formula:

$$(Na_2O)_6(Al_2O_3)_6(SiO_2)_{12}.27H_2O$$

but the mols of water present may be 15 to 27, e.g., 20 or 24 to 27. Note that in such chemical formula the x:y:z:w ratio is 1:1:2:4.5.

The alkali metal carbonate employed will desirably be of particle sizes within the No. 20 to 200 range U.S. Sieve Series (preferably 100 to 200), but various other sizes of particles, up to about 8 mesh and as fine as 325 mesh may be used, providing that they dissolve and/or disperse readily in the aqueous crutcher mix. Solutions may also be employed, provided that moisture contents of the crutcher mix resulting are not thereby raised too high. Normally the alkali metal (sodium or potassium being preferred) carbonate, most preferably as the sodium salt, will be essentially anhydrous in preferred embodiments of the invention but partially hydrated carbonates may also be used. The powdered carbonate is readily made into a suitable aqueous slurry with the zeolite and water, which slurry is easily spray dried to particles which readily sorb nonionic detergent, either alone or mixed with a suitable silicate such as a water soluble (hydrous) silicate. It is preferred that the carbonate employed be essentially pure sodium carbonate, usually over 95% pure, without the presence of bicarbonate which is in sodium sesquicarbonate, Wegscheider's salt or the commercial products which are mixtures of carbonates and bicarbonates, such as Snowlites, I and II (Allied Chemical Corporation).

The water of the crutcher mix and of the final product is preferably deionized water or water which may be present as the solvent in aqueous solution or dispersion of one or more of the components of the crutcher mix. The water employed, if added, will usually have a hardness content of less than 150 p.p.m., preferably less than 50 p.p.m. and more preferably less than 10 p.p.m., calculated as calcium carbonate. Although deionized water is preferable, tap waters low in hardness contents may also be employed. The moisture contents of the products are those which are removable by heating to a temperature of 105° C. for five minutes.

The water soluble alkali metal silicate which is employed is that which is usually referred to as a hydrous alkali metal silicate, preferably sodium silicate of $Na_2O:SiO_2$ ratio in the range of 1:1.5 to 1:2.5, preferably 1:1.8 to 1:2.4, e.g., 1:2. Although it is possible to add such silicate to the aqueous crutcher with the carbonate and the zeolite when, in making the present detergent compositions, such procedure is followed, objectionable deposits of residues are sometimes noted on washed fabrics or laundry and because such deposits are to be avoided and it has been found that they are substantially avoided by post-addition of hydrous alkali metal silicate, such post-addition method is normally utilized. In post-addition the hydrous sodium silicate, preferably in particulate or powdered form, usually with the particle sizes in the 10 to 200 mesh range, e.g., 10 to 150 mesh, will be admixed with the spray dried base beads of zeolite and carbonate before spraying onto tumbling surfaces of such mixture the nonionic detergent in liquid form for sorption by the spray dried beads and, to some extent, by the hydrous silicate. Typical hydrous sodium silicate screen analyses (for Britesils H20 and H24) follow: 55% through No. 10 sieve and on No. 48; 40% through 48, on 65; 4% through 65, on 100; and 3% through 100 on 150.

In addition to the mentioned components of the final product, in preferred compositions various adjuvants will also be favored. For example, to improve cleaning a proteolytic enzyme or equivalent enzyme may be post-added (normally such are not included in the crutcher mix because spray drying has an inactivating effect on such enzymes). The enzymes that may be employed are generally effective at pH ranges from about 4 to 12, preferably about 8 to 11. Although the proteolytic enzymes are subject to some degradation by heat they may be employed in washing solutions at temperatures up to about 80° C. and are also effective at low temperatures, down to about 10° C. Among the proteolytic enzymes that are useful may be mentioned pepsin, trypsin, chymotrypsin, bromelain, collagenase, keratinase, carboxylase, amino peptidase, elastase, subtilisin and aspergillopepidases A and B. Preferred enzymes are subtilisin enzymes manufactured and cultivated from special strains of spore-forming bacteria, particularly Bacillus subtilis.

Proteolytic enzymes such as Alcalase, Maxazyme, Protease AP, Protease ATP 40, Protease ATP 120, Protease L-252 and Protease L-432 are among those enzymes derived from strains of spore forming bacilli, such as Bacillus subtilis. Different proteolytic enzymes have different degrees of effectiveness in aiding in the removal of stains from textiles and linen. Particularly preferred as stain removing enzymes are subtilisin enzymes. Metalloproteases which contain divalent ions such as calcium, magnesium or zinc bound to their protein chains are of interest. The manufacture of proteolytic enzyme concentrates is described in German Offenlegenschrift No. 1,800,508 and in Dutch patent application, No. 6,815,944.

Instead of or in partial replacement of the proteolytic enzyme, other enzymes may also be used, usually for specific purposes. Thus, an amylase may be employed, e.g., acterial amylase of the alpha type, such as is obtained by fermentation of Bacillus subtilis. Among the other enzymes that may be used are those characterized as hydrolytic, lipolytic, oxidizing, reducing and glycolytic. Such include catalase, lipase, maltase and phosphatase. The mentioned enzymes and classes thereof, while considered to be most useful, are not the only effective ones in the present products. Virtually any enzymes that contribute to loosening of the bonds by which soils or stains are held to fibrous materials may be used in present formulas. Guides to such use may be found in *Principles of Biochemistry* by White, Handler, Smith and Stetten (1954).

Another preferred component of the present laundry detergents is a fluorescent brightener. The fluorescent brighteners are members of a well-known class in the detergent art and usually are reaction products of cyanuric chloride and the disodium salt of diamino stilbene disulfonic acid, benzidine sulfone disulfonic acid, amino coumarins, diphenyl pyrazoline derivatives or naphthotriazolyl stilbenes. Such materials are described in the article *Optical Brighteners and Their Evaluations* by Per S. Stensby, a reprint of articles published in *Soap and Chemical Specialties* in April, May, July, August and September, 1967, especially at pages 3–5 thereof. Among such brighteners are Tinopal 5BM (Geigy), Tinopal RBS, SOF (Ciba), and one known as Stilbene No. 4, disodium 4,4'-bis-(4-anilino-6-morpholine-s-triazine-2-ylamino)-2,2'-stilbene disulfonate. Of these, Tinopal 5BM is generally preferred.

Various other constituents and adjuvants may be present in the crutcher mix or may be post-added, including foam improvers, foam depressants, fungicides, antioxidants, sanitizers, stabilizers, chelating agents, soil suspending agents, soil anti-redeposition agents, colorants (pigments and dyes), bleaches and perfumes. Such materials are well-known in the art and need not be recited at length here. With respect to the making of the crutcher mix it is highly preferred to omit from such mix any surface active or detersive materials, which tend to produce lower bulk density spray dried beads.

The proportions of active materials in the final product should be in the range of 1:0.1–1.5:0.1–0.3:0.2–1.0 for zeolite:carbonate:silicate:nonionic detergent. Preferably, such proportions will be 1:0.2–1.0:0.15–0.25:0.3–0.8, respectively. Percentagewise, such constituents plus water are 25 to 70% of synthetic zeolite, 8 to 35% of sodium carbonate, 5 to 15% of hydrous sodium silicate, 15 to 25% of nonionic detergent and 2 to 15% of water. Normally 0 to 10% of adjuvants, e.g., 2 to 7% are also present. Preferably such percentages will be 30 to 60% of synthetic zeolite, 8 to 30% of sodium carbonate, 7 to 12% of hydrous sodium silicate, 17 to 23% of nonionic detergent and 5 to 12% of water. In a particular preferred formulation there will be present about 45% of zeolite, 13% of sodium carbonate, 8.1% of hydrous sodium silicate, 20% of nonionic detergent, 2% of fluorescent brightener, 1.5% of proteolytic enzyme, 0.2% of pigment, 0.3% of perfume and 9.9% of water. The fluorescent brightener content of these products will normally be in the range of 0.05 to 3%, preferably 1 to 2.5% and the proteolytic enzyme content, including normally present carrier for such enzyme, will be from 0.5 to 3%, preferably 1 to 2%, when present. Various other adjuvants which may also be employed will normally not total more than 5% and preferably will be less than 3%, with the percentages of individual components being less than 1% and preferably 0.5% or less. Thus, from 0.1 to 0.4% pigment may be present, as may be 0.1 to 0.4% perfume. If desirable, the percentage of anti-redeposition agent may be as high as 1% but normally the percentage thereof, if present, will be from 0.5–2.0%.

In the crutcher mix the percentages of components are usually 20 to 60% of zeolite, 5 to 30% of carbonate and 25 to 60% of water, possibly with 1 to 5% of adjuvants, too.

The high bulk density particulate heavy duty laundry detergent product of this invention will usually be in free flowing rounded bead form such as that of other spray dried products, although the bead interior may be virtually honeycombed. The particle sizes of the beads will normally be in the range of No's. 6 to 160 sieve, preferably No;s. 8 to 100 sieve, with less than 10%, preferably less than 5% and more preferably less than 1% of the product being outside such ranges. The bulk density of the finished detergent will normally be at least 0.6 g./ml., preferably at least 0.65 g./ml. and most preferably is in the 0.65 to 0.85 g./ml. range, e.g. 0.71 to 0.83 g./ml. The flow rates of such products are excellent and usually will be greater than 70% of the rate of free flowing sand of similar particle size, normally being from 70 to 95% thereof and preferably 75 to 95% thereof. Although the 0.65 to 0.85 g./ml. bulk density range is preferred, by changing formulas and spray drying techniques it can be changed upwardly and downwardly, e.g., to 0.5 and 0.9 g./ml.

In the manufacture of the invented laundry detergent it is important that a sorptive bead be made for absorption of nonionic detergent therein. Such sorption should be sufficient so that the nonionic detergent is passed into the bead interior and therefore does not tend to cause caking of the beads or poor flow properties. While some forms of sodium carbonate have been found to be good sorbents for nonionic detergents (most are not), products made with the acceptable sorbent alone as the builder, at least in quantities needed to make compositions of the type which are acceptably detersive tend to have objectionably high pH's. Even so, such products are not as free flowing as those of the present invention. For example, Flozan, a sodium carbonate formerly manufactured by Diamond Shamrock Corp., could absorb 20% of nonionic detergent but most carbonates were limited to 10%. Still Flozannonionic detergent mixtures were not as free flowing as the invented products. Also because carbonate tends to precipitate out calcium and magnesium and other alkaline earth metal and heavy metal ions as insoluble compounds it may give rise to chalkiness in washed materials. Still, when employed in the relatively small percentages of this invention in a spray dried product with synthetic zeolite of the type described, although both components may be considered as separately tending to increase residue problems on washed fabrics, it is found that when employed in the proportions described and with hydrous sodium silicate and nonionic detergent being post-added thereto the residue level is not objectionable. In other words, when the zeolite and carbonate are spray dried together in the proportions described, the product, which includes two materials, each of which may develop residue problems, is found to be better than would be expected with respect to residue deposition. Furthermore, the relatively small quantity of carbonate present reduces the toxicity of the product and diminishes the likelihood of esophageal burns if the product should be accidentally ingested by infants or children.

In manufacturing the absorbent, yet comparatively high bulk density spray dried detergent base beads, the spray drying operation is conducted in a normal manner, with only zeolite, carbonate, water and temperature stable adjuvants, such as fluorescent brightener and pigment, normally being present. It is possible to spray dry a limited quantity of silicate, usually no more than 15% thereof, e.g., 5 to 12%, together with the rest of the crutcher mix but generally it is preferred to post-add hydrous sodium silicate instead. If silicate is spray dried with the rest of the base composition it will preferably be a sodium silicate of $Na_2O:SiO_2$ ratio in the range of 1:2.0 to 1:2.5, e.g., about 1:2.4.

Whether or not the silicate is present in the crutcher mix such mix will normally include about 40 to 75% of solids and about 25 to 60% of water. Preferably, the water content will be about 25 to 50 or 60%, with the balance of the mix being non-surface active solids. The crutcher will usually be provided with heat exchange means so that the temperature of the mix may be regulated, normally within the range from room temperature to 90° C., preferably 20° to 70° C. and most preferably about 45° to 65° C. Crutching times are usually in the range of 5 minutes to one hour, preferably 10 minutes to 30 minutes and within this range will desirably be as short as possible with the obtaining of good mixing. If any silicate is present in the crutcher mix it will usually be added as an aqueous solution with the other components, the carbonate, heat-stable adjuvants and zeolite, with the zeolite preferably being admixed last, often as a slurry (some of the water of the crutcher mix being utilized to form the slurry). If the silicate should thicken the mix objectionably during crutching it may be subjected to high shear, as described in an application of the present inventors entitled High Bulk Density Particulate Heavy Duty Laundry Detergent, executed and filed on the same dates as the present application.

After completion of crutching the crutcher mix is atomized, preferably by being forced through a circular nozzle of internal diameter in the range of about 0.5 to 2 mm., at a pressure of about 10 to 50 kg./sq. cm. gauge, into a spray tower, preferably a countercurrent spray tower, in which the drying air is at a temperature of about 150° to 350° C. The tower may be about 8 to 15 meters high and about 2 to 4 meters in diameter and the product exiting therefrom is of particle sizes substantially in the 6 to 160 U.S. Sieve Series range and is screened so as to be substantially all within such range or a narrower range, e.g., 8 to 100. Instead of high pressure atomization of the particles through an orifice, spinning disc atomization or equivalent methods may be employed.

After production of base particles, when they contain no silicate a particulate solid silicate such as hydrous sodium silicate, preferably of the type sold by Philadelphia Quartz Company as Britesil, of 1:2 or 1:2.4 $Na_2O:SiO_2$ ratio, is mixed with the base beads in an inclined drum or other mixing and/or tumbling device, normally over a period of about 1 to 5 minutes, and nonionic detergent, in liquid state and at a temperature in the range of 20° to 70° C., preferably 30° to 60° C., is sprayed onto the tumbling surfaces of the base beads, preferably after dry mixing thereof with powdered hydrous sodium silicate. The atomized globules of nonionic detergent may be of any suitable size but normally are in the 0.5 to 3 mm. diameter range, preferably 1 to 2 mm. dia. Spray application of the nonionic detergent to the tumbling particles normally takes place over a period of from 1 to 20 minutes, preferably from 2 to 10 minutes. While the base particles may be heated to temperatures from 30° to 60° C. to promote maintenance of normally pasty or solid nonionic detergent in liquid form this is usually not done because heating of the detergent suffices to accomplish this and for the normally liquid detergents no heating is needed. After completion of addition of the nonionic detergent other materials to be post-added, such as proteolytic enzyme and perfume, may be applied. It is possible to apply the proteolytic enzyme and any other powders first, merely by mixing it or them with the base particles including nonionic detergent, normally over a period of 1 to 10 minutes, preferably from 1 to 5 minutes, and to post-add the perfume over similar periods of time, preferably as a spray, with the sprayed globules being of sizes like those described for the nonionic detergent. Particle sizes of the product may be regulated by controlling the mixing conditions and the particle sizes of the powders and sprayed droplets but usually screening after manufacture will also be employed to obtain the desired 6 to 160 or 8 to 100 sieve size ranges.

The advantages of the present invention with respect to product and process have been mentioned but now will be discussed in further detail. The free-flowing high bulk density particulate product lends itself to ready and convenient use. The package employed may be a "bottle", rather than a large detergent box, which is decidedly less convenient. The bottle may be capped and so may be positively sealed from external moisture, which sometimes causes lumping of detergents, and may be protected from spilling. Because of the higher bulk density, in addition to the packaging being of more convenient size and type, the volume of detergent composition to be utilized is smaller and more readily measured. Of course, great savings in storage and display space at point of sale are made. Although in some circumstances a limited proportion of phosphate, e.g., up to 10%, may be intentionally added to the present compositions, preferably in the crutcher mix, it is a feature of this invention that excellent absorption of nonionic detergent and excellent detergency, with little or no depositing of residue onto washed items, is obtained without the use of any phosphate. Phosphates have generally been considered to be better builders than the other known detergent builders and are usually more sorptive of nonionic detergents and other liquids. Still, in the present case, the combination of zeolite and relatively small quantity of cabonate behaves similarly and is especially useful in conjunction with nonionic detergent, preferably with hydrous sodium silicate being post-added to the base beads before (but sometimes after, too) addition of nonionic detergent. The base beads made, without any detergent or surface active agent being present in them, are of the desired characteristics for their subsequent manufacture into a finished detergent composition by post-spraying of a nonionic organic detergent onto them. The relatively small quantity of carbonate keeps the alkalinity of the product low and maintains the pH, at a normal use concentration of 0.05 to 0.1% in wash water, e.g., 0.07%, ($\frac{1}{4}$ cup in a standard 17 gallon washing machine tubful of water) in the range of about 8.5 to 11, preferably 9 to 10.5. The mentioned pH is safer for washing than higher pH's and is ideal for the action of any enzyme contained in the product and thereby helps to improve the washing and stain removing effects of the detergent composition.

The product resulting, of the composition described and made by the methods mentioned, is of excellent flow characteristics and is of a higher density than a comparable product including bicarbonate, described in the co-filed application previously mentioned. Such may be attributable to the higher percentage of zeolite present but it is surprising that a product so high in zeolite content, with additional sodium carbonate, should not produce unacceptably high residue deposits on washed laundry. Also, in the present compositions, although it has been taught that appreciable contents of silicates, whether post-added or co-spray dried with other portions of detergent composition, are likely to produce zeolite-silicate or other residues on washed laundry, in the present instance it is found that any residues resulting are generally commerically acceptable and are not cause for rejection of the product by the consumers.

The various advantages of the product and process are obtainable without extra materials or processing expenses other than the cost of the molecular sieve zeolite component and the use of phosphate is avoided. Also, because the detergent employed is nonionic it is less susceptible to interference from water hardness ions and other impurities and therefore the products are better washing agents under a wider variety of conditions, including cold water washing. Even in high hardness waters the compositions tend to disperse better any insoluble carbonates which may be formed. Finally, although carbonate in waste wash water entering the sewer and passing into inland waters is a source of carbon, required by living organisms, it is not nearly as likely to cause eutrophication of inland waters as is phosphate, in most circumstances, and accordingly, is more likely to be tolerated therein.

The following examples illustrate but do not limit the invention. Unless otherwise indicated all parts are by weight and all temperatures are in °C.

EXAMPLE 1

| | Percent |
|---|---|
| *Neodol 23-6.5 (Shell Chemical Company | 20.0 |
| **Molecular Sieve Zeolite 4A, crystalline ultimate particle size of 4 to 8 microns (Union Carbide Corp.) | 45.0 |
| $Na_2CO_3$ | 13.0 |
| **Hydrous sodium silicate, Britesil, manufactured by Philadelphia Quartz Company ($Na_2O:SiO_2$ = 1:2.4) | 8.1 |
| Tinopal 5BM fluorescent brightener | 2.0 |
| Proteolytic enzyme | 1.5 |
| Ultramarine Blue pigment | 0.2 |
| Perfume | 0.3 |
| Water (including water of hydration of zeolite, silicate, etc.) | 9.9 |
| | 100.0 |

*Condensation product of higher fatty alcohol of an average of 12 to 13 carbon atoms with about 6.5 mols of ethylene oxide/mol.
**Anhydrous basis A free flowing, high bulk density particulate detergent composition is prepared of the above formula and is of essentially globular particles, 99% of which are of sizes (usually considered as of diameters) in the range of 8 to 100 mesh, U.S. Sieve Series. The product has a bulk density of 0.79 g./ml. and flows at a rate about 91% of that of dry sand of similar particle size, the standard for comparison. It is an excellent heavy duty synthetic organic detergent, useful for both hot and cold water washing of both synthetic and natural fiber textiles and it does not leave objectionable residues on such textiles, such as may often be observed after washing with other synthetic detergent compositions wherein substantial proportions of zeolite insoluble inorganic builder and silicate are employed together, when employed at concentrations of 0.05 to 0.15%, e.g., 0.07%, in wash water of medium hardness, e.g., 75 to 125 p.p.m., as $CaCO_3$.

The product is made by admixing in a synthetic detergent or soap crutcher at a temperature of 60° C. (the water is initially heated and heat on the crutcher is maintained to reach and hold such temperature) zeolite and sodium carbonate, plus stable adjuvants, such as pigment and brightener. The parts by weight employed are 55 of the zeolite (hydrated), equal to 45 parts of anhydrous zeolite, 13 of sodium carbonate, 0.2 of the pigment, 2 of the brightener and 50 of deionized water (plus 10 parts water in the zeolite). Alternatively, city water of low hardness, less than 50 p.p.m., as calcium carbonate, is substituted for the deionized water in some cases. After about 20 minutes of crutching at a temperature of about 60° C. the crutcher mix is spray dried in a conventional countercurrent spray tower, which is about ten meters high and three meters in diameter, by pumping it at a pressure of about 25 kg./sq. cm. gauge through an orifice about 1 mm. in diameter into drying air (at a temperature of about 300° C. inlet and 110° C. outlet) so as to produce a product of a moisture content of about 14% (removable at 105° C. for 5 minutes), substantially, usually over 80%, in the 6 to 160 U.S. Sieve Series range, which product is cooled to about room temperature (if above that) and screened so as to be substantially all (over 99%) within such range. Alternatively, screening is effected to particle sizes in the narrower 8 to 100 mesh range. In both instances the base detergent composition beads made are of a high bulk density, about 0.6 g./ml. and are free flowing, with such flow being about 80% or more of that of comparably sized dry sand.

With the base beads are blended about 10 parts of hydrous sodium silicate (8:1 parts of anhydrous silicate) of particle sizes in the 10 to 100 mesh range (to result in the formula quantity of silicate in the product) and after about five minutes mixing there are sprayed onto the mixture 20 parts of the Neodol 23-6.5 in liquid state at a temperature of about 35° C. The particles onto which the Neodol 23-6.5 is sprayed as a liquid mist, with droplet diameters of about 2 mm., are initially at room temperature (about 25° C.) The spraying is effected within a period of about 8 minutes, after which the product is perfumed by spraying and the proteolytic enzyme powder, of a particle size between 60 and 100 mesh, is dusted onto the surfaces of the particles, still in the mixing drum, each of which procedures takes about three minutes. The product is then allowed to cool to 30° C. (if at a higher temperature) to prevent loss of perfume components by evaporation.

The finished product, screened to 8 to 100 mesh size, is of the desired high bulk density and very good flow characteristics and is "bottled", packed and warehoused so as to be ready for shipment. When tested, it is found to be a satisfactory heavy duty detergent, useful for washing in both hot and cold waters, especially so at low concentrations, e.g., 0.07% in wash water, and surprisingly, leaves little or no visible residue of zeolite and/or silicate or other materials on the washed fabrics. The product remains free flowing during storage. It does not cake objectionably nor does it develop lazy flow characteristics. The pH of a 0.15% solution thereof in wash water is about 9.8 and that of a 0.07% solution is about 9.5, ideal pH's for proteolytic enzymatic action, which assists the detergent composition in cleaning and removing stains from washed fabrics, whether of synthetic (nylon, polyester and permanent press natural-synthetic blends) or natural fabrics (cottons).

When the silicate is included in the crutcher mix instead of being post-added (a 40% solids content aqueous solution of $Na_2O:SiO_2$ ratio of about 1:2.4 is used instead of particulate hydrous silicate) an additional five minutes crutching time is taken to blend the silicate with the rest of the crutcher mix (it is added to the carbonate and water before addition of the zeolite and the water content of the silicate solution is taken into account in computing the amount of water to be added to the crutcher). The product obtained is a good heavy duty detergent of high bulk density and is sufficiently free flowing to be commercially acceptable but is not considered to be as good as the product of the previous example given.

In another variation of the experiment the hydrous sodium silicate, in powder form, is admixed with the rest of the product and at least partially adhered to it after spraying onto such product of the nonionic detergent. The composition obtained, while acceptable, is not as good as that wherein the particulate hydrous sodium silicate is mixed with the zeolite first, prior to spraying onto the mix of the nonionic detergent. Flow properties are not as good, some caking on storage is noted and some segregation occurs.

Instead of employing the inclined drum for mixing and spray applications, when this is replaced by a twin-shell, V- or Patterson-Kelly-type blender equivalent products are made.

Although, as indicated in the earlier portion of this example, it is preferred to post-add the nonionic detergent to the beads shortly after manufacture and also to post-add any other components of the product not in the spray dried base beads this can also be done after aging of the base beads for periods from 20 minutes to several days, without loss of their absorbing powers. In such cases it may be desirable to heat the beads before application of the nonionic detergent but by proper choice of nonionic detergent type, with respect to melting point, this is avoidable.

EXAMPLE 2

When in the processes and products of Example 1 the crystalline zeolite 4 A is replaced by the corresponding amorphous material, which has an ultimate particle size (diameter) in the 0.01 to 0.05 micron range or when the "hole" in the zeolite is increased or decreased, while still being good for trapping hardness ions, e.g., to 3 to 6 Å, the composition obtained is of essentially the same flow and bulk density properties as that of the product of Example 1, is an excellent heavy duty laundry detergent which leaves no residue on washed clothing and sometimes is of even superior properties with respect to flow and absence of residue, compared to the crystalline product. This is also true but to a lesser extent when 50:50 amorphous:crystalline zeolite mixtures are employed. When type X zeolites are employed instead of type A such effects are also obtainable. Similary, when type Y zeolites are utilized and other equivalents thereto, useful products are obtainable although they are not as good as those including the type A and/or X zeolites.

The products of this example and of Example 1 are also useful when the silicate is included partially in the crutcher and partially in the inclined drum mixer, e.g., half in each, preferably with the first being $Na_2O:SiO_2$ of 1:2.4 silicate and the latter being hydrous sodium silicate of 1:2 ratio. Alternatively, although not preferably, the silicate and adjuvants may be omitted.

In addition to varying the type of zeolite present the types of silicates and nonionic detergent may be changed, as may be those of the various adjuvants. Thus, in the experiment of Example 1, instead of employing the hydrous silicate of $Na_2O:SiO_2$ ratio of 1:2, such ratio may be 1:1.8 or 1:2.2 and the products obtained are still like those previously described. Instead of utilizing Neodol 23-6.5, Neodol 25-7 and Neodol 45-11 and equally proportioned 2- and 3-component mixtures of such materials are employed. Instead of Tinopal 5BM, others of the previously mentioned fluorescent brighteners may be substituted or the brightener may be omitted entirely. In the latter case the product obtained is of essentially the same detersive and physical properties, although desirable brightening of laundry is noticeably diminished in the absence of the fluorescent compound. In other variations of the procedure and products of Example 1 the proteolytic enzyme and the Ultramarine Blue are omitted from the formula. Alternatively, the colorant is employed in larger proportion to color some product particles while others are uncolored and beads of both types are mixed to produce a speckled version.

In addition to the various components listed others are also included, e.g., inert filler, such as sodium sulfate, anti-redeposition agents, such as sodium carboxymethyl cellulose, antibacterial agents, such as tetrabromosalicylanilide, laundry sweetening (and building salts), such as borax and bleaching materials, such as sodium perborate. The stable materials are usually preferably added in the crutcher whereas the others are post-added, either before or after spray-on of the nonionic detergent. When such materials are present in the described compositions, for example, 5% of borax, 5% of sodium sulfate, 0.5% of sodium carboxymethyl cellulose, 0.1% of antibacterial compound and 10% of sodium perborate, the product formula will be modified accordingly, preferably by proportional diminutions of zeolite, carbonate and silicate contents.

In place of the sodium salts of the various mentioned components corresponding potassium or other suitable soluble salts, preferably alkali metal salts, are substituted, either in whole or in part, providing that the characteristics of the products obtained are acceptable and within the ranges given.

EXAMPLE 3

A crutcher formula is made by admixing 47 parts of sodium aluminum silicate (molecular sieve type LMS-9611, obtained from Union Carbide Corp.), 9.5 parts of light soda ash, 1.7 parts of Tinopal 5BM Conc., 0.2 part of Ultramarine Blue pigment and 41.6 parts of water so that the crutcher mix is of 48% solids content. The zeolite measurement given is the weight of hydrated zeolite added (otherwise in this specification and in the claims anhydrous weights are used). Wet and dry remix are also added (q.s.) in such proportions as to maintain the 48% solids content. The crutcher mix is dried as described in Example 1 and a yield of 56.4 parts results, with a moisture loss of 43.6 parts. 67.1 Parts of product are mixed with 10.0 parts of Britesil H-20 (hydrous sodium silicate, on an "as is" basis) and 0.3 part of sodium carboxymethyl cellulose (90% active) and 20.0 parts of Neodol 23-6.5 are sprayed onto the moving mixture, in the manner described in Example 1, after which the product is perfumed and 1.5 parts of alkaline protease are dusted onto it. The proteolytic enzyme and sodium CMC are of the particle sizes previously described for the enzyme and the Britesil H-20 is of the sieve analysis previously given. The nonionic detergent is at 35° C. and the beads onto which it is sprayed are at room temperature (25° C.). The product resulting contains 44.1% (anhydrous basis) of the zeolite, 11.3% of sodium carbonate, 2% of Tinopal 5BM Conc., 0.2% of Ultramarine Blue, 1.5% of proteolytic enzyme, 20.0% of the nonionic detergent, 8.1% of silicate solids, 1.0% of sodium CMC active ingredient, 0.3% of perfume and 11.5% of moisture (including moisture in the zeolite and hydrous sodium silicate). The cup weight is 185 grams per 240 ml. and flowability is greater than 70% of that of similarly sized sand. As with the products of the previous examples, it is a good heavy duty laundry detergent which does not leave white deposits on washed laundry to an objectionable extent.

EXAMPLE 4

| | Percent |
|---|---|
| Neodol 23-6.5 | 19.2 |
| Type 4A zeolite (hydrated, but anhyd. basis) | 45.2 |
| $Na_2CO_3$ | 12.8 |
| Hydrous sodium silicate (anhydrous basis) | 8.6 |
| Fluorescent brightener | 2.0 |
| Proteolytic enzyme | 1.3 |
| Pigment | 0.2 |
| Moisture | 10.7 |
| | 100.0 |

The above product is made by the method previously described for Examples 1–3. The product resulting has a cup weight of 182 g. and a flow which corresponds to 91% of that of similarly sized sand. The particle sizes are like those of the products previously mentioned. It is a useful detergent and is superior to a commercially successful detergent when tested for cleaning power against mixed soils on a plurality of fabrics. After washing soiled laundry with it none to light residue is observable on dark colored clothing to a careful observer and such is considered to be commercially acceptable. The product ages well and passes various other tests for non-caking, appearance, stain removal, etc.

EXAMPLE 5

The compositions of the products of the previous examples are varied ±10%, ±20% and ±30%, within the ranges given and similarly, the procedures are varied with respect to times and temperatures. The products made are within the desired ranges for flow characteristics, bulk density and particle size and are of satisfactory heavy duty laundry detersive properties. For example, the moisture content of the finished product is varied to 5%, 6% and 10% and all of the products are of acceptable flow characteristics. The nonionic detergent content is increased to as much as 25% with various formulas within the invention and the silicate content is increased to 15% and, with proper selection of the formula to produce the most free flowing product, to as high as 20% and even, sometimes, 25%. Of course, in all such instances wherein the formulas are varied, both with respect to components and with respect to proportions, care will be taken by one of skill in the art so as to make a product of desired properties by means of a commercially practicable method.

The invention has been described with respect to illustrative examples and descriptions thereof but is not to be limited to these because it is evident that one of skill in the art, with the present specification before him, will be able to utilize substitutes and equivalents and make various modifications within the scope of the invention.

What is claimed is:

1. A free flowing, phosphate-free, particulate, heavy duty laundry detergent product having a bulk density of greater than about 0.6 g per ml comprising porous, spray-dried base beads of about 45% crystalline zeolite particles having ultimate particle sizes of 15 microns or less, about 13% sodium carbonate, about 8% anhydrous sodium silicate having an $Na_2O:SiO_2$ ratio of about 1:2.4, said sodium silicate being combined in a hydrous form, and said beads having about 20% nonionic surfactant absorbed into the interior of said beads, said percentages being by weight relative to the total weight of the composition;

said nonionic surfactant containing beads being produced by:

(a) preparing a crutcher mix by adding about 55 parts hydrated crystalline zeolite particles (45 parts anhydrous basis) in the form of an aqueous slurry to an aqueous slurry of 13 parts sodium carbonate and 10 parts water-soluble sodium silicate having an $Na_2O:SiO_2$ ratio of 1:2.4 to form a gel, said zeolite having an average ultimate particle diameter of about 15 microns or less, the total water content of the mix being 50 parts and the sodium silicate being added as a 40% solids aqueous solution;

(b) shearing the gel to reduce the viscosity thereof, (c) spray-drying the crutcher mix to form said spray-dried beads having a water content of about 14% and (d) mixing with about 80 parts of said beads about 20 parts of said surfactant in liquid form so that the surfactant is absorbed into the beads to produce said nonionic detergent containing spray-dried beads.

2. A detergent product according to claim 1 wherein the nonionic surfactant is a condensation product of a higher fatty alcohol of an average of 12 to 13 carbon atoms with about 6.5 mols of ethylene oxide per mol of alcohol.

3. A detergent product according to claim 1 wherein the zeolite particles are 4 A molecular sieves.

4. A detergent product according to claim 1 wherein the density is about 0.8 g per ml.

5. A detergent product according to claim 1 wherein the step of spray drying is accomplished in drying air at an inlet temperature of 300° C. and an outlet temperature of 110° C.

6. A detergent product according to claim 1 wherein said zeolite particles have sizes of from about 4 to about 8 microns.

7. A detergent product according to claim 1 wherein the spray-dried bead particles have mesh sizes from 6 to 160 in U.S. Sieve Series.

* * * * *

UNITED STATES PATENT AND TRADEMARK OFFICE

CERTIFICATE OF CORRECTION

PATENT NO. : 4,457,854

DATED : July 3, 1984

INVENTOR(S) : Gangwisch, Richter, Wixon and Wraga

It is certified that error appears in the above—identified patent and that said Letters Patent is hereby corrected as shown below:

| | | | | | |
|---|---|---|---|---|---|
| Column 6 | Line 22 | Change | "and" | to | --to-- |
| Column 7 | Line 48 | Change | "L-432" | to | --L-423-- |
| Column 7 | Line 63 | Change | "acterial" | to | --bacterial-- |

Signed and Sealed this

*Twentieth* Day of *November 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,457,854

DATED : July 3, 1984

INVENTOR(S) : William J. Gangwisch, et al

It is certified that error appears in the above-identified patent and that said Letters Patent is hereby corrected as shown below:

The term of this patent subsequent to April 28, 1998, has been disclaimed.

Signed and Sealed this

*Third* Day of *September 1985*

[SEAL]

*Attest:*

DONALD J. QUIGG

*Attesting Officer* *Acting Commissioner of Patents and Trademarks - Designate*